US010521990B2

(12) United States Patent
Sato et al.

(10) Patent No.: US 10,521,990 B2
(45) Date of Patent: Dec. 31, 2019

(54) DIGITAL KEY SYSTEM

(71) Applicant: TOKAI RIKEN CO., LTD., Seki-shi, Gifu-ken (JP)

(72) Inventors: Akihiro Sato, Seki (JP); Nobuhiko Segi, Ogaki (JP); Masami Umemura, Gifu (JP)

(73) Assignee: TOKAI RIKEN CO., LTD., Seki (JP)

( * ) Notice: Subject to any disclaimer, the term of this patent is extended or adjusted under 35 U.S.C. 154(b) by 0 days.

(21) Appl. No.: 16/288,581

(22) Filed: Feb. 28, 2019

(65) Prior Publication Data

US 2019/0304223 A1 Oct. 3, 2019

(30) Foreign Application Priority Data

Mar. 30, 2018 (JP) ..... 2018-068967
Jul. 13, 2018 (JP) ..... 2018-133311

(51) Int. Cl.
*G07C 9/00* (2006.01)

(52) U.S. Cl.
CPC ..... *G07C 9/00309* (2013.01); *G07C 2009/00507* (2013.01); *G07C 2009/00587* (2013.01); *G07C 2009/00777* (2013.01)

(58) Field of Classification Search
CPC ..... G07C 9/00309; G07C 2009/00769; G07C 9/00571; G07C 9/00111; G07C 9/00007; G07C 2209/63; G07C 2009/00793
USPC ..... 340/5.61
See application file for complete search history.

(56) References Cited

U.S. PATENT DOCUMENTS

| | | | | |
|---|---|---|---|---|
| 5,351,042 | A | 9/1994 | Aston | |
| 9,940,768 | B2 * | 4/2018 | Carstens | A47G 29/141 |
| 2016/0094545 | A1 | 3/2016 | Dixit et al. | |
| 2016/0323863 | A1 * | 11/2016 | Park | H04W 4/70 |
| 2017/0063566 | A1 * | 3/2017 | Seminario | H04L 12/2816 |
| 2019/0006891 | A1 * | 1/2019 | Park | H02J 50/80 |
| 2019/0080189 | A1 * | 3/2019 | Van Os | G06K 9/00912 |

FOREIGN PATENT DOCUMENTS

| | | | |
|---|---|---|---|
| EP | 3 001 341 | A1 | 3/2016 |
| JP | H09-132977 | A | 5/1997 |
| JP | 2014-058854 | A | 4/2014 |
| JP | 2014-173376 | A | 9/2014 |
| JP | 5727845 | B2 | 6/2015 |
| JP | 2016-215779 | A | 12/2016 |

OTHER PUBLICATIONS

Aug. 1, 2019 Extended European Search Report issued in European Patent Application No. 19163497.1.

* cited by examiner

*Primary Examiner* — Mark S Blouin
(74) *Attorney, Agent, or Firm* — Oliff PLC

(57) ABSTRACT

In a digital key system, each of a digital key and a digital lock include two terminals and an electric circuit to superimpose and separate a high-frequency signal and a DC current. A microcomputer is operated by DC current supplied from a battery of the digital key through the electric circuit when the digital key is connected to the digital lock, thereby causing an NFC unit to perform communication by the high-frequency signal with the digital key through the electric circuit, read unlocking authority information from a non-contact memory, and authenticate the read unlocking authority information.

7 Claims, 8 Drawing Sheets

DIGITAL KEY SYSTEM

CROSS-REFERENCE TO RELATED APPLICATIONS

This application is based upon and claims the benefit of priority from the prior Japanese Patent Applications No. 2018-68967 filed on Mar. 30, 2018 and No. 2018-133311 filed on Jul. 13, 2018, the entire contents of which are incorporated herein by reference.

BACKGROUND

Technical Field

This disclosure relates to a digital key system for locking and unlocking a digital lock by use of a digital key.

Related Art

As a conventional art, Patent Document 1 discloses a digital key system. This digital key system includes a digital lock attached to a storage cabinet, a digital key to be used in common by a plurality of users to unlock the digital lock, and a digital key box that includes personal authentication means and is configured to storage and manage digital keys centrally.

Further, Patent Document 2 discloses an electronic lock system configured to transmit and receive data mutually between a key and a lock body to lock or unlock. Patent Document 3 discloses a user specification system configured to identify a user who uses an electronic key. Patent Document 4 discloses a control system configured to perform action control such as activation of an information device and so on in synchronization with opening/closing using a key. Furthermore, Patent Document 5 discloses a key system with a key having an RFID tag.

RELATED ART DOCUMENTS

Patent Documents

Patent Document 1: Japanese Patent No. 5727845

Patent Document 2: Japanese patent unexamined application publication No. H09-132977 (1997)

Patent Document 3: Japanese patent unexamined application publication No. 2016-215779

Patent Document 4: Japanese patent unexamined application publication No. 2014-58854

Patent Document 5: Japanese patent unexamined application publication No. 2014-173376

SUMMARY

Technical Problems

In the digital key system disclosed in Patent Document 1, the digital lock is a lock to be powered by a battery. Thus, when the battery has run out or is running low, a troublesome work for battery change is required. In particular, when a storage cabinet is installed on a place or site not easily accessible (for example, facilities to which access is restricted or some places deep in the mountains), it is not easy to change the battery of the digital lock. In such a case, when a user intends to unlock the digital lock with the digital key, the digital lock may not be unlocked because of shortage of battery power.

It is thus conceivable to derive power for the digital lock from an external power source. However, when a storage cabinet is installed on a site where external power is not easily available, the digital lock also may not be unlocked.

Since a digital key is to be used in common by a plurality of users, therefore, it is necessary to authenticate the authority required to unlock a digital lock with the digital key to be used. Thus, a controller of the digital lock has to authenticate the authority while obtaining drive power. However, this may lead to a complicated structure of the digital key system.

In the system disclosed in Patent Document 2, the lock body is operated by power (electric current) supplied from the key. However, an exciting unit needs to be provided to convert DC current supplied from a battery provided in the key to AC current (e.g., high-frequency (HF) energy, high-frequency signal) through an exciting circuit. For this purpose, the system structure tends to be complicated and the exciting circuit of the exciting unit has to be activated to supply the power from the key to the lock body. This activation of the exciting circuit of the exciting unit may generate power loss and cause additional power consumption. Therefore, when a lock is placed in a mountainous secluded area that few people usually go to, the key needs to be provided with a power switch to cut normal power consumption in order to save management of power consumption.

The system disclosed in Patent Document 3 is premised on a key and a lock each of which is provided with a power supply. This system is intended to specify a user by authenticating ID information through communication means, such as radio transmission.

The system disclosed in Patent Document 4 is premised on a key and a lock each of which is provided with a power supply. This system is intended to reduce management cost by authenticating ID information through some communication means and further by registering an operation or action record on an IC tab of a key.

In the system disclosed in Patent Document 5, the key is provided with an antenna to be connected to an IC tag, and a terminal part of a conductive substrate to be connected to the antenna. Furthermore, the lock is provided with a power supply and configured to contact with the key to exchange information when the key is inserted in the lock. For supply of power to the IC tag, high-frequency energy is supplied from the lock through a contact portion of the conductive substrate.

The present disclosure has been made to address the above problems and has a purpose to provide a digital key system with a simple structure to enable a controller of a digital lock to obtain drive power from a digital key and authenticate authority information of the digital key.

Means of Solving the Problems

To achieve the above-mentioned purpose, one aspect of the present disclosure provides a digital key system comprising: a digital key; a digital lock to be locked and unlocked with the digital key; and a controller configured to control the digital lock, wherein the digital key includes a battery and a non-contact memory configured to store unlocking authority information corresponding to information of an authority needed to unlock the digital lock, the controller includes: a near field communication unit configured to perform communication with the digital key; and a microcomputer configured to control the near field communication unit, the digital key and the digital lock each include two terminals and are configured to provide an electric circuit when the digital key and the digital lock are connected to each other through the respective two terminals, the electric circuit being configured to superimpose and separate a high-frequency signal and a DC current, and when the microcomputer starts operating upon receiving the DC current supplied from the battery through the electric circuit when the digital key is connected with the digital lock, the microcomputer being configured to cause the near field communication unit to perform communication by the high-frequency signal with the digital key through the electric circuit to read the unlocking authority information from the non-contact memory, and authenticate the read unlocking authority information.

According to the above configuration, the digital key and the digital lock use respective two terminals to perform communication by a high-frequency signal and supply DC current through an electric circuit configured to superimpose and separate the high-frequency signal and the DC current. Thus, the digital key system can be simplified in structure with the small number of terminals necessary to connect the digital key and the digital lock. Thus, the controller of the digital lock can obtain drive power from the digital key and authenticate authority information of the digital key through the simple structure.

According to a digital key system of the present disclosure, a controller of a digital lock is enabled with a simple structure to obtain drive power from a digital key and authenticate authority information of a digital key.

BRIEF DESCRIPTION OF THE DRAWINGS

FIG. 10 is a diagram showing a key and a lock which utilizes an RFID in a common access management system and the like.

DETAILED DESCRIPTION OF THE EXEMPLARY EMBODIMENTS

A detailed description of an embodiment of a digital key system which is one of typical embodiments of this disclosure will now be given referring to the accompanying drawings.

<Whole Configuration of Digital Key System>

Figure 1:
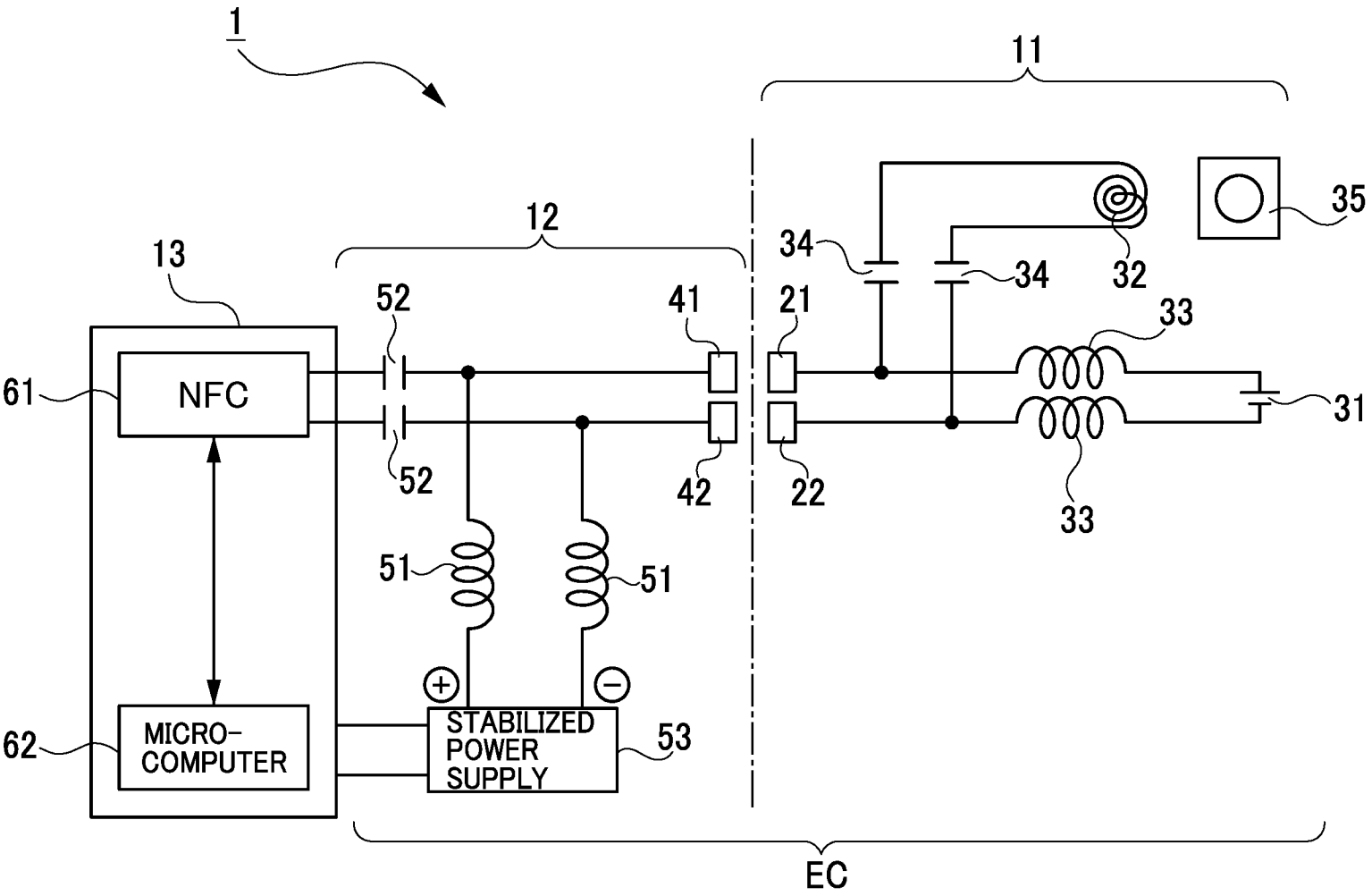
FIG. 1 is a configuration diagram of a digital key system in a present embodiment.

As shown in FIG. 1, a digital key system 1 in the present embodiment includes a digital key 11, a digital lock 12, and a controller 13. This digital key system 1 is configured to read unlocking authority information from the digital key 11 when this digital key 11 is inserted in a key hole of a lock (e.g., a lock 74 shown in FIG. 3 which will be mentioned later) connected to a digital lock 12, perform authentication and, if the authentication is successful, unlock the digital lock 12.

<Schematic Configuration of Digital Key>

Figure 2:
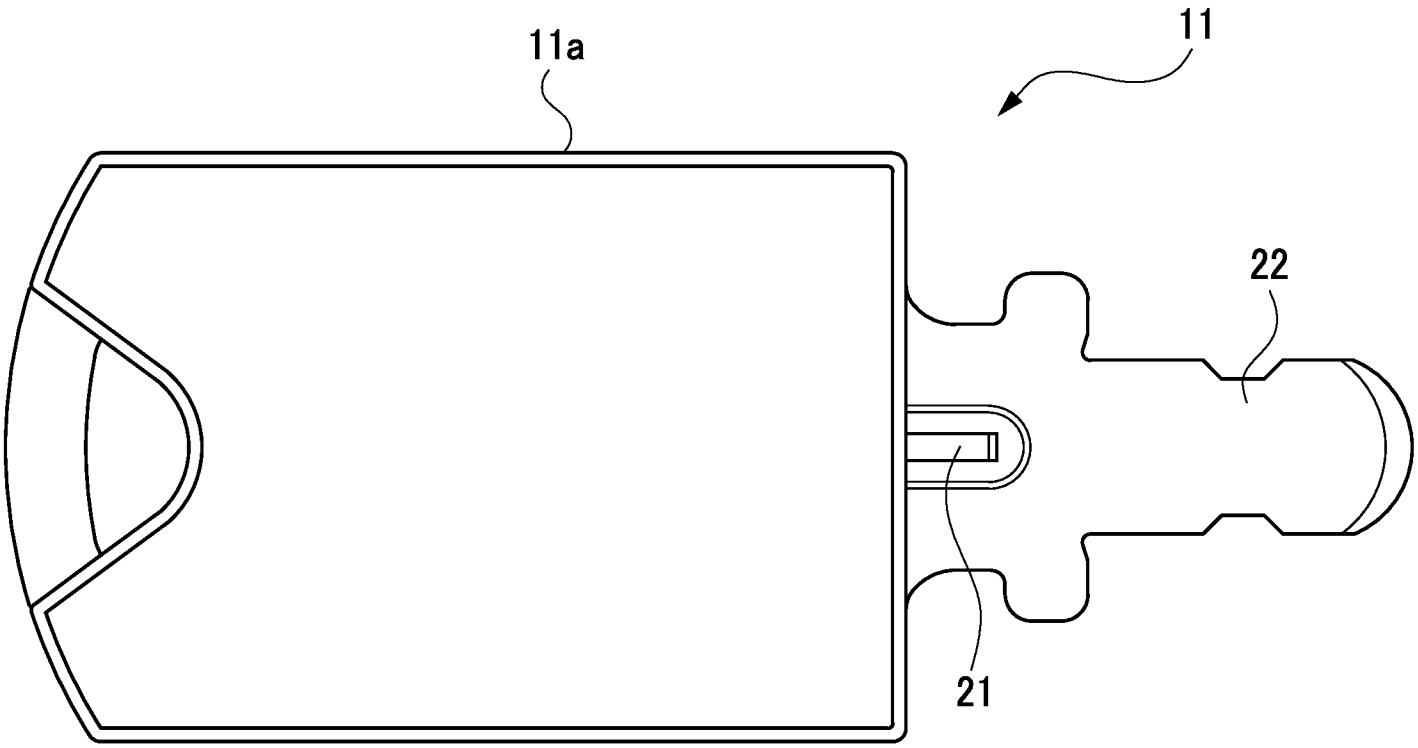
FIG. 2 is a diagram showing one example of a digital key in the present embodiment.

The digital key 11 will be described below. As shown in FIG. 2, the digital key 11 includes a key body 11*a*, and a first terminal 21 (i.e., a first key terminal) and a second terminal 22 (i.e., a second key terminal) each protruding out from the key body 11*a* and being insertable in the key hole of the lock.

The key body 11*a* is provided with an electric circuit shown in FIG. 1. This electric circuit includes a battery 31, an electromagnetic induction coil 32, inductance coils 33 which are one example of a key-side inductance coil, condensers 34 which are one example of a key-side condenser, and a non-contact memory 35. To be specific, the inductance coils 33 are provided, one in an electric wire that connects the first terminal 21 to the battery 31 and the other in an electric wire that connects the second terminal 22 to the battery 31. The condensers 34 are provided, one in an electric wire that connects an intermediate portion between the first terminal 21 and the corresponding inductance coil 33 to the electromagnetic induction coil 32 and the other in an electric wire that connects an intermediate portion between the second terminal 22 and the other inductance coil 33 to the electromagnetic induction coil 32.

The battery 31 is a rechargeable battery, such as a polymer lithium battery. The electromagnetic induction coil 32 is a coil to read information from the non-contact memory 35 in a non-contact manner. The inductance coils 33 are electronic components configured to pass DC current and block a high-frequency signal. The condensers 34 are electronic components configured to pass a high-frequency signal and block DC current. The non-contact memory 35 is a memory configured to store the unlocking authority information and unlocking execution information. The unlocking authority information is the information on authority needed to unlock the digital lock 12. The unlocking execution information is the information indicating that unlocking of the digital lock 12 was executed.

<Schematic Configuration of Digital Lock>

The schematic configuration of the digital lock 12 will be described below. The digital lock 12 is configured to be unlocked and locked with the digital key 11. This digital lock 12 includes a first terminal 41 (i.e., a first lock terminal) and a second terminal 42 (i.e., a second lock terminal). These first terminal 41 and second terminal 42 will be connected respectively to the first terminal 21 and the second terminal 22 of the digital key 11 when the digital key 11 is inserted in the key hole of the lock connected to the digital lock 12. In the present embodiment, specifically, the digital key 11 and the digital lock 12 are connected to each other through the respective two terminals.

Furthermore, the digital lock 12 is provided with an electric circuit shown in FIG. 1. This electric circuit includes inductance coils 51 which are one example of a lock-side inductance coil, condensers 52 which are one example of a lock-side condenser, and a stabilized power supply 53. To be specific, the condensers 52 are provided, one in an electric wire that connects the first terminal 41 to an NFC (Near Field Communication) unit 61 which will be mentioned later and the other in an electric wire that connects the second terminal 42 to the NFC unit 61. The inductance coils 51 are provided, one in an electric wire that connects an intermediate portion between the first terminal 41 and the corresponding condenser 52 to the stabilized power supply 53 and the other in an electric wire that connects an intermediate portion between the second terminal 42 and the other condenser 52 to the stabilized power supply 53. The inductance coils 51 are electronic components to pass DC current and block a high-frequency signal. The condensers 52 are electronic components to pass a high-frequency signal and block DC current. The stabilized power supply 53 is a power supply circuit to be controlled to output the voltage of DC current at a continuously constant value and is connected to the controller 13.

In the digital key 11 and the digital lock 12 in the present embodiment, moreover, the electric circuit of the digital key 11 and the electric circuit of the digital lock 12 are connected to each other through two terminals, that is, the first terminals 21 and 41 and the second terminals 22 and 42 as shown in FIG. 1, thereby forming an electric circuit EC to superimpose and separate the high-frequency signal and the DC current.

<Schematic Configuration of Controller>

The schematic configuration of the controller 13 will be described below. The controller 13 is configured to control the digital lock 12 and includes the NFC unit 61 and a microcomputer 62. The NFC unit 61 is one example of a near field communication unit in the present disclosure. Specifically, the NFC unit 61 is configured to perform near-field radio communication and communicate with the digital key 11. The microcomputer 62 is configured to control the NFC unit 61.

<Operations of Digital Key System>

The above configured digital key system 1 is operated as below. Firstly, the unlocking authority information is written into the non-contact memory 35 of the digital key 11. This writing of the unlocking authority information into the non-contact memory 35 is performed through a network by use of a terminal; for example, a smartphone. It is to be noted that writing of the unlocking authority information, into the non-contact memory 35 may be carried out for example by insertion of the digital key 11 into a digital key box (not shown).

Secondly, a user inserts the digital key 11 into a key hole of a lock to connect the digital key 11 to the digital lock 12. Accordingly, the first terminal 21 of the digital key 11 is connected to the first terminal 41 of the digital lock 12 and also the second terminal 22 of the digital key 11 is connected to the second terminal 42 of the digital lock 12. In the above manner, the digital key 11 and the digital lock 12 are connected to each other through the two terminals.

Since an inductance coil allows DC current to pass, the DC current from the battery 31 of the digital key 11 passes through the inductance coils 33 and the inductance coils 51 and then is transmitted to the controller 13 through the stabilized power supply 53. On the other hand, since a condenser does not allow DC current to pass, the DC current from the battery 31 of the digital key 11 is blocked by the condensers 34 and the condensers 52 and therefore is not transmitted to the electromagnetic induction coil 32 and the NFC unit 61. In the above manner, the microcomputer 62 starts operating upon receiving the DC current (i.e., drive current) supplied from the battery 31 of the digital key 11 through the electric circuit EC.

The microcomputer 62 to be operated as above causes the NFC unit 61 to perform communication by a high-frequency signal (a signal having for example a frequency of 13.56 MHz) with the digital key 11 through the electric circuit EC to read unlocking authority information from the non-contact memory 35. Specifically, the NFC unit 61 performs communication by a high-frequency signal with the non-contact memory 35 to obtain the unlocking authority information stored in the non-contact memory 35. Herein, since a condenser allows a high-frequency signal to pass, the high-frequency signal passes through the condensers 52 and the condensers 34 to transmit between the NFC unit 61 and the electromagnetic induction coil 32. On the other hand, since an inductance coil does not allow a high-frequency signal to pass, the high-frequency signal is blocked by the inductance coils 51 and the inductance coils 33 and thus is not transmitted to the battery 31 and the stabilized power supply 53. Thus, the microcomputer 62 performs authentication of the unlocking authority information read as above.

In the present embodiment, specifically, the electric circuit EC operates to superimpose the DC current from the battery 31 of the digital key 11 and the high-frequency signal transmitted from the non-contact memory 35 via the electromagnetic induction coil 32, and transmit the superimposed signal from the digital key 11 to the digital lock 12. In the digital lock 12, thereafter, the superimposed signal is separated into the DC current and the high-frequency signal so that they are transmitted respectively to the microcomputer 62 and the NFC unit 61.

When the unlocking authority information is successfully authenticated, the microcomputer 62 unlocks the digital lock 12. Thus, the digital key 11 inserted in for example a key hole of a lock of a storage cabinet is enabled to rotate, thereby allowing a door of the storage cabinet to be opened. At that time, furthermore, the non-contact memory 35 of the digital key 11 stores the unlocking execution information.

In the present embodiment, the unlocking authority information written in the non-contact memory 35 enables only one-time unlocking of the digital lock 12. Therefore, after the digital lock 12 is unlocked once, if this digital lock 12 is to be unlocked again, the unlocking authority information has to be written in the non-contact memory 35 again.

<Examples of Application>

Figure 3:
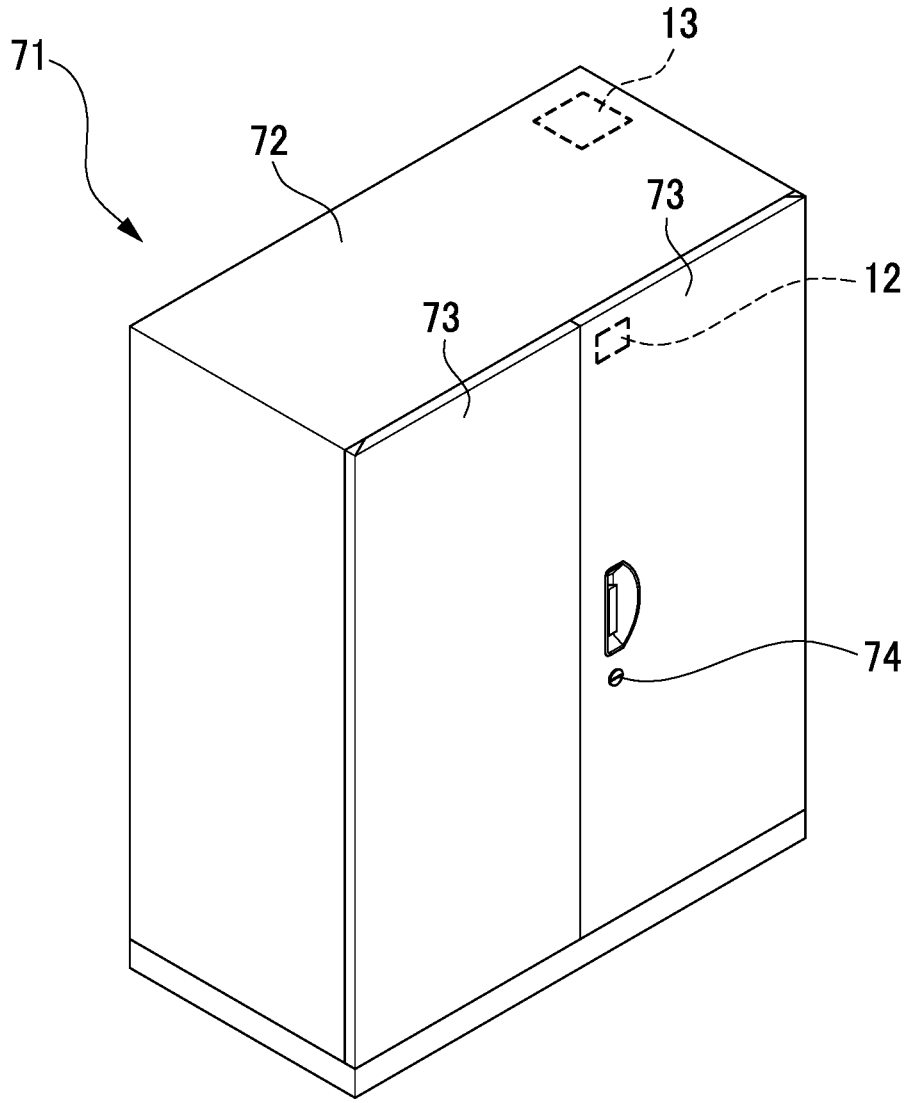
FIG. 3 is a perspective view showing one example of a storage cabinet to which the digital key system is applied in the present embodiment.

The digital key system 1 in the present embodiment can be applied to for example a storage cabinet 71 as shown in FIG. 3. The storage cabinet 71 is provided with a main body 72 and doors 73 for opening/closing an opening of the main body 72 as shown in FIG. 3. The digital lock 12 is attached to one of the doors 73 and the controller 13 is mounted in the main body 72. The door 73 attached with the digital lock 12 is further provided with a lock 74 having a hole in which the digital key 11 can be inserted. This lock 74 is connected to the digital lock 12. The controller 13 may be provided as a part of the digital lock 12.

<Differences Between Present Embodiment and Patent Documents>

Hereinafter, differences of the digital key system 1 in the present embodiment from the foregoing conventional arts, i.e., Patent Documents 2 to 5, will be mentioned.

The digital key system 1 in the present embodiment is configured such that the lock (e.g., the digital lock 12) is not provided with a power supply (e.g., a battery) in order to reduce man-hour for managing consumption of a battery and keep records of authentication and operation of the system even when the lock is placed in a mountainous secluded area that few people usually go to. As above, the digital key system 1 in the present embodiment is intended to achieve a lock with no power supply. This configuration is therefore different in purpose to be achieved from the systems disclosed in Patent Documents 3 to 5 in which each lock includes a power supply.

Herein, the foregoing system in Patent Document 2 is configured such that the lock includes no power supply. In other words, the digital key system 1 in the present embodiment and the system in Patent Document 2 are common in the configuration that a key is provided with a battery (e.g., a DC power supply) and the power energy (i.e., electric power, electric current) from this battery is supplied to a lock through a connection part in which the key and the lock are connected to each other. However, regarding the flow of supply of the power energy in the connection part in which the key and the lock are connected, the digital key system 1 in the present embodiment is obviously different from the system in Patent Document 2.

Figure 7:
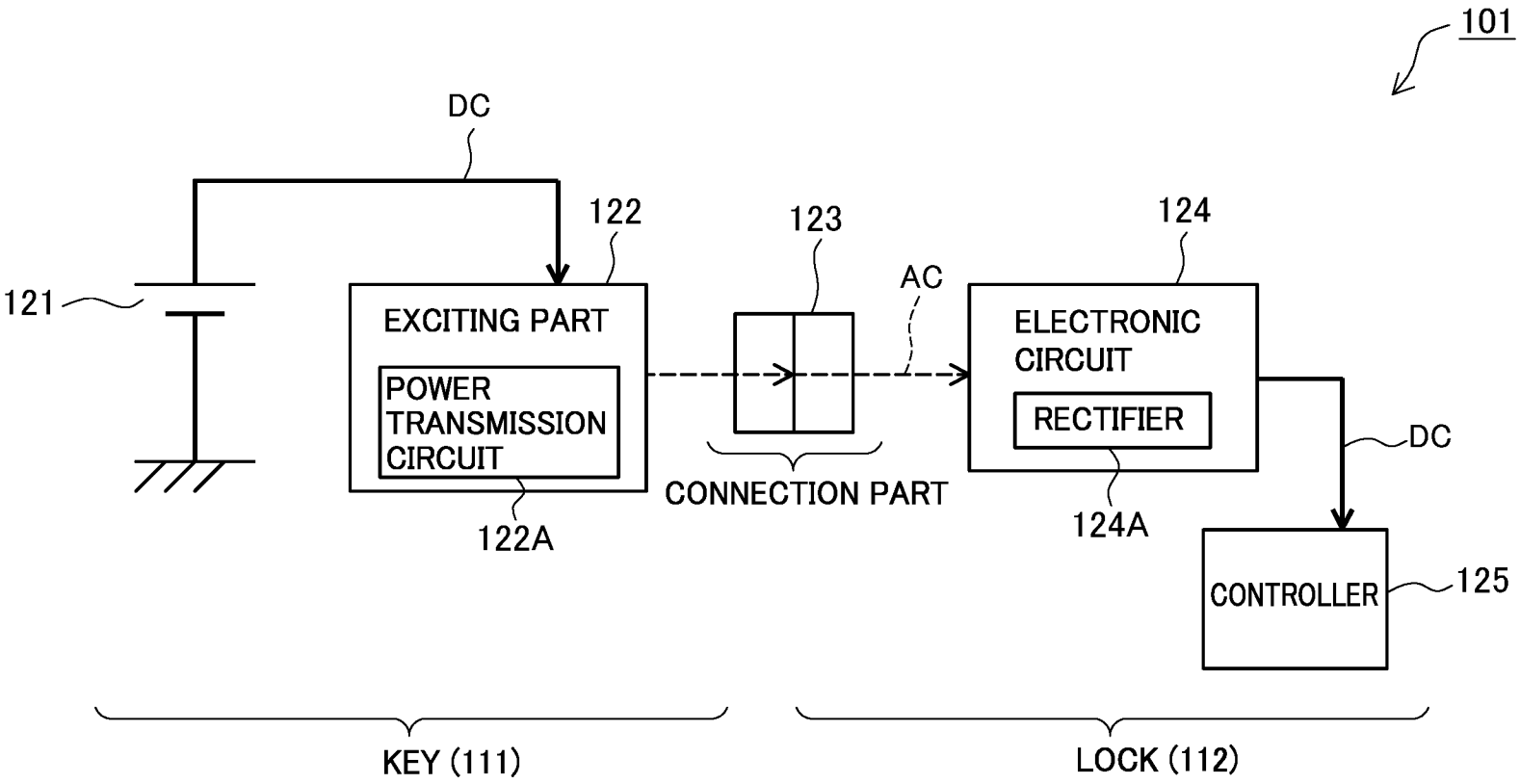
FIG. 7 is a schematic configuration diagram of a system in Patent Document 2.
Figure 8:
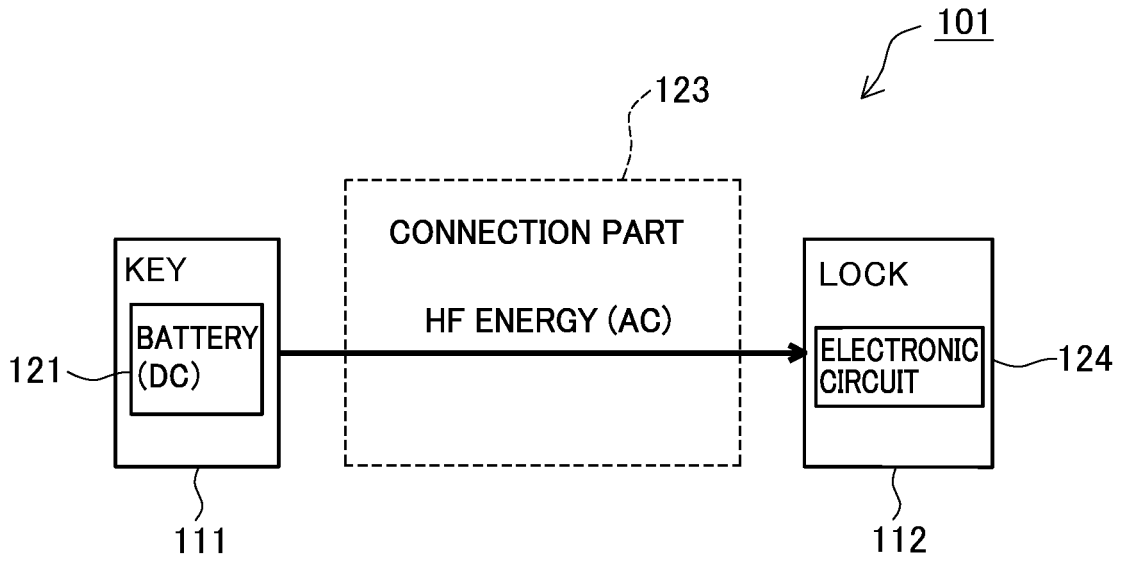
FIG. 8 is a diagram showing directions of supply of power energy in a connection part in the system in Patent Document 2.

In the system 101 in Patent Document 2, as shown in FIG. 7, the power energy derived from a battery 121 of a key 111 is supplied to a lock 112 via a power transmission circuit 122A (e.g., an exciting circuit) of an exciting unit 122 and a connection part 123 (i.e., a connection part of the key 111 and the lock 112). To be concrete, the DC current supplied from the battery 121 is converted to AC current through the power transmission circuit 122A of the exciting unit 122. This converted AC is then supplied to the lock 112 through the connection part 123. The AC supplied to the lock 112 is converted to DC current through a rectifier 124A of an electronic circuit 124, and then the converted DC current is supplied to a controller 125. In the system 101 in Patent Document 2, therefore, high-frequency (HF) energy (AC current) is merely supplied as power energy in one way from the key 111 to the lock 112 as shown in FIG. 8.

In the system 101 in Patent Document 2 configured as above, the power transmission circuit 122A (e.g., the exciting circuit) of the exciting unit 122 has to be activated in order to supply power from the key 111 to the lock 112. This generates power loss due to activation of the power transmission circuit 122A (e.g., the exciting circuit) of the exciting unit 122, resulting in power consumption. When the lock 112 is placed in a mountainous secluded area that few people normally go to, therefore, the key 111 needs to be provide with a power switch to cut normal power consumption in order to save management of power consumption caused by activation of the power transmission circuit 122A (e.g., the exciting circuit).

Figure 4:
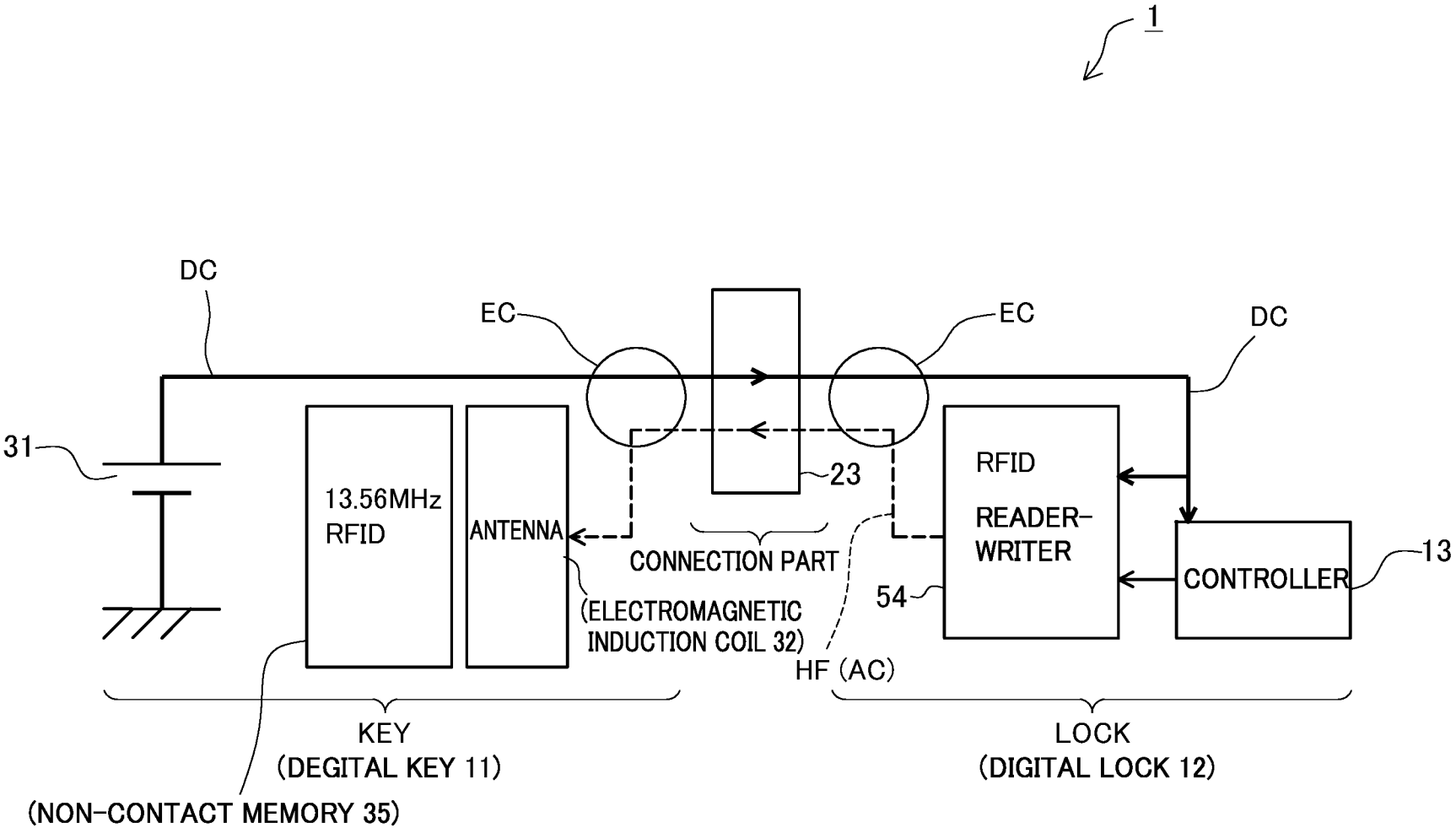
FIG. 4 is a schematic configuration diagram of the digital key system in the present embodiment.

In contrast, as shown in FIG. 4, in the digital key system 1 in the present embodiment, the DC current derived from the battery 31 of the key is supplied to the lock through the connection part 23 (i.e., the connection part consisting of the first terminals 21 and 41 and the second terminals 22 and 42) through which the key (i.e., the digital key 11) and the lock (i.e., the digital lock 12) are connected. The digital key system 1 in the present embodiment configured as above does not include the power transmission circuit (i.e., the exciting circuit) and the rectifier needed for the system 101 as disclosed in Patent Document 2. Specifically, the digital key system 1 in the present embodiment is different from the system 101 in Patent Document 2 in that DC current supplied from the battery 31 of the key is not converted to AC current and thus the DC current is directly supplied to the lock.

In the digital key system 1 in the present embodiment configured as above, there are not the power transmission circuit (e.g., the exciting circuit) and the rectifier needed for the system 101 in Patent Document 2. Accordingly, the digital key system 1 in the present embodiment does not generate any power loss due to activation of the power transmission circuit (e.g., the exciting circuit) and hence does not cause power consumption. Thus, when a lock (e.g., the digital lock 12) is placed in a mountainous secluded area that few people usually go to, it is unnecessary to manage power consumption caused by activation of the power transmission circuit (e.g., the exciting circuit) and hence a power switch does not need to be provided to cut normal power consumption.

In the digital key system 1 in the present embodiment, furthermore, when the lock receives supply of DC current, an RFID (radio frequency identifier) reader-writer 54 (which is provided for example in the NFC unit 61 shown in FIG. 1) starts to operate. Accordingly, the RFID reader-writer 54 generates a high-frequency (HF) signal of e.g. 13.56 MHz, so that this high-frequency signal is supplied to an antenna (e.g., the electromagnetic induction coil 32) in the key. At that time, the high-frequency signal is supplied from the lock to the key through the connection part 23 and used as a carrier for supply of power energy (i.e., HF energy, AC current) and information communication to an RFID (e.g., the non-contact memory 35) located near the antenna.

Figure 5:
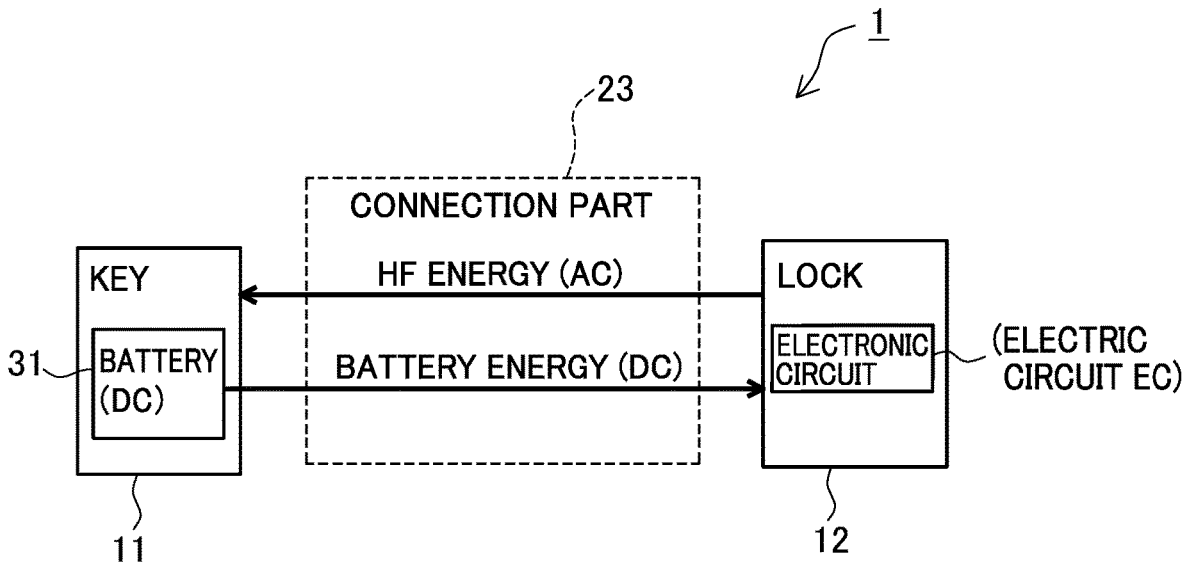
FIG. 5 is a diagram showing directions of supply of power energy in a connection part in the digital key system in the present embodiment.

In the digital key system 1 in the present embodiment, accordingly, in the connection part 23, the DC current and the high-frequency signal are superimposed to mutually supply power energy (electric power) between the lock and the key. In FIG. 4, specifically, the DC current and the high-frequency signal are superimposed on the same wire in the connection part 23 and the DC current and the high-frequency signal are separated from and mixed with each other through the electric circuit EC. In the digital key system 1 in the present embodiment, as shown in FIG. 5, the power energy is supplied in two ways, that is, from the key to the lock and from the lock to the key. Specifically, battery energy (DC current) is supplied as the power energy from the key 11 to the lock 12 and the HF energy (AC current) is supplied as the power energy from the lock 12 to the key 11.

Figure 9:
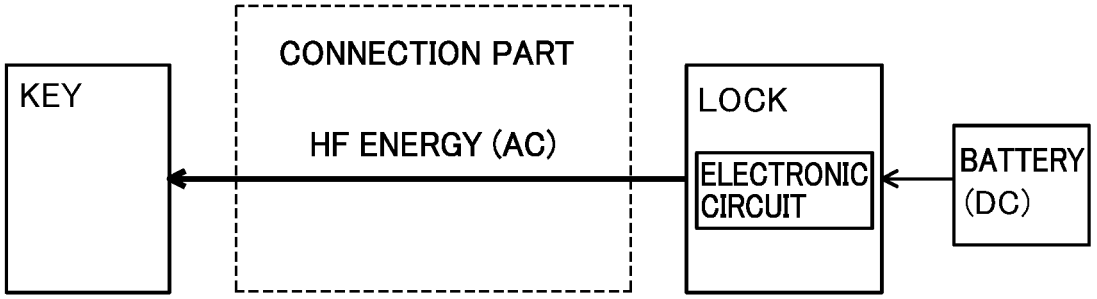
FIG. 9 is a diagram showing directions of supply of power energy in a connection part in a system in Patent Document 4.

In the system in Patent Document 4, as shown in FIG. 9, HF energy (AC current) is merely supplied as power energy in only one way, that is, from the lock to the key.

The foregoing configuration of the digital key system 1 in the present embodiment is summarized below.

(1) When the battery 31 of the key is connected to the lock, power is supplied from the battery 31 to the RFID reader-writer 54. The RFID reader-writer 54 generates a high-frequency (HF) signal of e.g. 13.56 MHz upon receiving power in the form of the DC current supplied from the battery 31.

(2) The generated high-frequency signal can be supplied to an antenna of the key through the use of a DC current line (i.e., a transmission path of the DC current). At this time, the high-frequency signal can be mixed with, or superimposed on, the DC current.

(3) The high-frequency signal transmitted to the antenna (i.e., the electromagnetic induction coil 32) of the key is connected by electromagnetic induction to the RFID placed near the antenna.

(4) Since the RFID is placed near the antenna, the RFID can use part of the high-frequency signal as power (i.e., HF energy, AC current) to allow communication with the RFID reader-writer 54.

(5) Specifically, even when the lock has no power supply, the battery 31 of the key can operate the lock to allow access management using the RFID.

<Differences from General RFID System>

The digital key system 1 in the present embodiment is basically identical in structure to a general RFID system, but greatly differs from the general RFID system in a power supply method used to utilize the digital key system 1. Specifically, the digital key system 1 in the present embodiment is configured with a different method for power supply to an RFID system from a conventional method, so that the digital key system 1 can be beneficially used.

Therefore, the structure of the RFID system in the digital key system 1 in the present embodiment and the position of a power supply thereof will be explained below by comparison with the structure of the general RFID system and the position of a power supply thereof.

Figure 10:
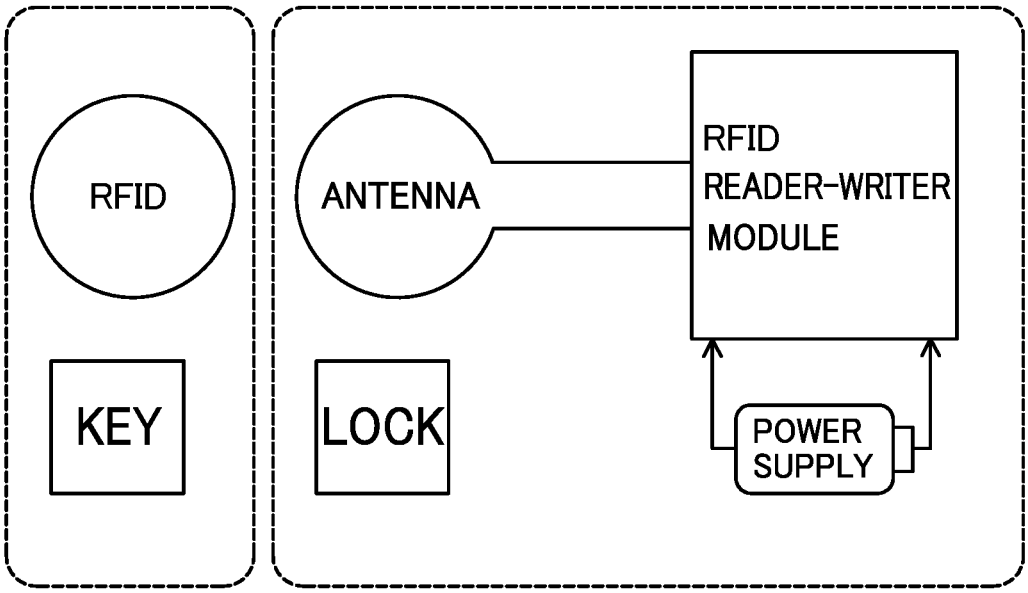

In the general RFID system, as shown in FIG. 10, a RFID reader-writer module is supplied with power from a power supply (e.g., a battery) provided in a lock.

Figure 6:
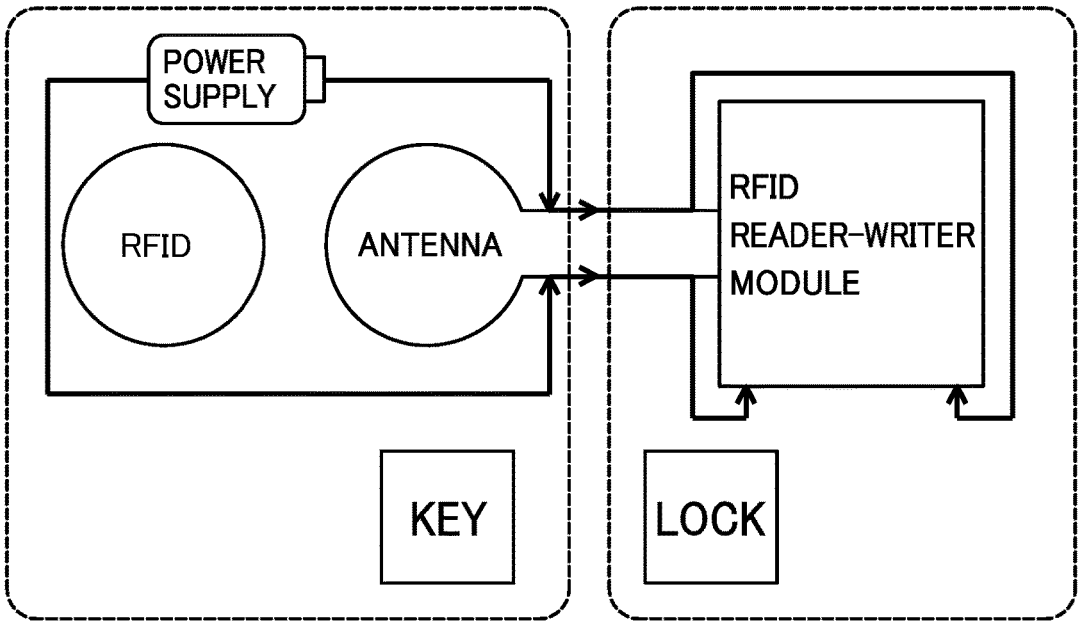
FIG. 6 is a diagram showing a structure of a key and a lock that utilizes an RFID and a power supply method in the digital key system in the present embodiment.

In contrast, the digital key system 1 in the present embodiment is identical in the structure of an RFID system to the general RFID system shown in FIG. 10, excluding that a power supply (e.g., the battery 31) and an antenna (e.g., the electromagnetic induction coil 32) are placed in the key (e.g., the digital key 11) as shown in FIG. 6. In other words, the RFID system in the digital key system 1 in the present embodiment and the general RFID system are different in boundary line of dividing the key and the lock in FIGS. 6 and 10. However, they become identical in structure when each key is connected to each lock at the time of unlocking. In the digital key system 1 in the present embodiment, as shown in FIG. 6, the power is to be supplied to the RFID reader-writer module (e.g., the RFID reader-writer 54) through a wiring from the antenna. The RFID reader-writer module thus starts operating upon receiving supply of the power, generating a high-frequency signal. Accordingly, supply of power to the RFID and intercommunication between the key and lock can be achieved by utilizing the high-frequency signal through the antenna.

The digital key system 1 in the present embodiment is provided with the system structure identical to the conventional general RFID system and improved in power supply method to eliminate the need to additionally provide a power supply device, such as a battery, which is needed in the lock. If the lock includes a battery, this battery needs to be replaced regularly before it runs out and thus such a replacement work leads to an increase in management load. In the digital key system 1 in the present embodiment, however, there is no need to manage a power supply (e.g., a battery) on the lock side. Consequently, the lock can be placed even in mountainous secluded areas or isolated islands where the lock could not be placed heretofore. Furthermore, the digital key system 1 in the present embodiment can provide the following advantages. One advantage is that the RFID system is almost identical in structure to currently widely available RFID systems and thus mass-produced electronic parts or components can also be directly utilized for the digital key system 1. Another advantage is that availability of such mass-produced parts enables a digital key system (i.e., an electronic lock system) to be provided at low cost.

Furthermore, the RFID in the key in FIG. 6 can communicate with not only the antenna inside the key but also an antenna placed outside the key. Accordingly, the RFID can provide many characteristics; for example, it can read a usage history and write an authority by use of a smartphone having an NFC (Near Field Communication) function and thus can be utilized as an Internet of Things (IoT) device of the key.

<Operations and Effects>

In the digital key system 1 in the present embodiment, as described above, the digital key 11 and the digital lock 12 are connected to each other through the two terminals, thereby forming an electric circuit EC to superimpose and separate a high-frequency signal and a DC current. The microcomputer 62 starts operating upon receiving the DC current supplied from the battery 31 provided in the digital key 11 through the electric circuit EC when the digital key 11 is connected to the digital lock 12. The microcomputer 62 operated in such a way causes the NFC unit 61 to perform communication by the high-frequency signal with the digital key 11 through the electric circuit EC to read the unlocking authority information from the non-contact memory 35, and authenticate the read unlocking authority information.

As above, the digital key 11 and the digital lock 12 perform intercommunication by the high-frequency signal and supply of the DC current through the electric circuit EC by use of the two terminals. Thus, the digital key system 1 can be simplified in structure with a reduced number of terminals for connecting the digital key 11 and the digital lock 12. With this simple structure, therefore, the microcomputer 62 can obtain DC current from the digital key 11 and authenticate the unlocking authority information.

Accordingly, even when the storage cabinet 71 provided with the digital lock 12 is installed on a site not easily accessible (for example, facilities to which access is restricted or some places deep in the mountains), the digital lock 12 does not need battery change and further the microcomputer 62 can obtain drive power from the digital key 11 to perform authentication of the unlocking authority information.

Moreover, even when the storage cabinet 71 provided with the digital lock 12 is placed on a site where external power is not easily available, the digital lock 12 does not need to obtain the external power and further the microcomputer 62 can obtain drive power from the digital key 11 to authenticate the unlocking authority information.

Furthermore, the battery 31 of the digital key 11 has only to be used as a drive power supply at least for the microcomputer 62 to perform authentication of the unlocking authority information and therefore power consumption can be kept down, leading to a long battery life. Since the digital key 11 needs no microcomputer, the structure of the digital key 11 can be simplified.

The electric circuit EC includes the inductance coils 33 provided in the digital key 11 and configured to pass DC current and block a high-frequency signal and the condensers 34 provided in the digital key 11 and configured to pass a high-frequency signal and block DC current. The electric circuit EC further includes the inductance coils 51 provided in the digital lock 12 and configured to pass DC current and block a high-frequency signal and the condensers 52 provided in the digital lock 12 and configured to pass a high-frequency signal and block DC current. Accordingly, the above simple structure enables superimposition and separation of the high-frequency signal and the DC current.

In the connection part 23 where the two terminals; that is, the first terminals 21 and 41 and the second terminals 22 and 42, are connected with each other, a DC current and a high-frequency signal are superimposed, so that power (electric energy) is mutually supplied between the digital key 11 and the digital lock 12. Thus, even when the digital lock 12 includes no power supply, the battery 31 of the digital key 1 can operate the digital lock 12 to allow access management using the RFID.

In the digital key system 1 in the present embodiment, the unlocking authority information is the information that enables unlocking of the digital lock 12 until the unlocking authority information itself is deleted or within the limit of the number of times of using the digital lock 12. For example, the unlocking authority information is only valid until it is deleted or within the limited number of times of usage. This makes it possible to prevent the digital lock 12 from being unlocked without authority by use of the digital key 11 which can be commonly used by more than one user.

In the digital key system 1 in the present embodiment, moreover, the non-contact memory 35 is configured to store unlocking execution information representing that unlocking of the digital lock 12 was executed. This allows a user to check of the unlocking history that the digital lock 12 was executed.

In the digital key system 1 in the present embodiment, the non-contact memory 35 is configured to write therein the unlocking authority information through a network. Accordingly, even when no dedicated device (e.g., a digital key box) for writing unlocking authority information into the non-contact memory 35, the unlocking authority information can be written into the non-contact memory 35 by use of a terminal connected to a network. Thus, in any places as long as under an environment where a network is available, the unlocking authority information can be written into the non-contact memory 35.

The non-contact memory 35 has only to store at least the unlocking authority information and the unlocking execution information. For the non-contact memory 35, therefore, a low-cost memory having a low memory capacity can be used.

The digital key system 1 may be configured such that the digital lock 12 includes for example an LED (one example of a display unit) which is turned on to indicate that the microcomputer 62 has started operating by connection of the digital key 11 to the digital lock 12. This enables a user to externally check that the microcomputer 62 is operating, so that the user can verify that the digital key 11 currently being used is undergoing authentication of the unlocking authority information. Furthermore, the LED may be lighted on or blinked to indicate that the microcomputer 62 has checked the unlocking authority information and successively authenticated the digital lock 12, that is, the digital lock 12 has been unlocked.

The foregoing embodiments are mere examples and give no limitation to the present invention. The present invention may be embodied in other specific forms without departing from the essential characteristics thereof.

REFERENCE SIGNS LIST

1 Digital key system
11 Digital key
12 Digital lock
13 Controller
21 First terminal
22 Second terminal
12 Connection part
31 Battery
32 Electromagnetic induction coil
33 Inductance coil
34 Condenser
35 Non-contact memory
41 First terminal
42 Second terminal
51 Inductance coil
52 Condenser
53 Stabilized power supply
54 RFID reader-writer
61 NFC unit
62 Microcomputer
71 Storage cabinet
74 Lock
EC Electric circuit

What is claimed is:

1. A digital key system comprising:
a digital key;
a digital lock to be locked and unlocked with the digital key; and
a controller configured to control the digital lock,
wherein the digital key includes a battery and a non-contact memory configured to store unlocking authority information corresponding to information of an authority needed to unlock the digital lock,
the controller includes:
a near field communication unit configured to perform communication with the digital key; and
a microcomputer configured to control the near field communication unit,
the digital key and the digital lock each include two terminals and are configured to provide an electric circuit when the digital key and the digital lock are connected to each other through the respective two terminals, the electric circuit being configured to superimpose and separate a high-frequency signal and a DC current, and
when the microcomputer starts operating upon receiving the DC current supplied from the battery through the electric circuit when the digital key is connected with the digital lock, the microcomputer being configured to cause the near field communication unit to perform communication by the high-frequency signal with the digital key through the electric circuit to read the unlocking authority information from the non-contact memory, and authenticate the read unlocking authority information.

2. The digital key system according to claim 1, wherein the electric circuit comprises:
a key-side inductance coil provided in the digital key and configured to pass the DC current and block the high-frequency signal;
a key-side condenser provided in the digital key and configured to pass the high-frequency signal and block the DC current;
a lock-side inductance coil provided in the digital lock and configured to pass the DC current and block the high-frequency signal; and
a lock-side condenser provided in the digital lock and configured to pass the high-frequency signal and block the DC current.

3. The digital key system according to claim 1 further including a connection part in which the two terminals of the digital key and the two terminals of the digital lock are connected to each other,
wherein the connection part is configured to superimpose the DC current and the high-frequency signal to mutually supply power between the digital key and the digital lock.

4. The digital key system according to claim 1, wherein the unlocking authority information enables unlocking of the digital lock until the authority information is deleted or within a limit of the number of times of using the digital lock.

5. The digital key system according to claim 1, wherein the non-contact memory is configured to store unlocking execution information representing that unlocking of the digital lock was executed.

6. The digital key system according to claim 1, wherein the non-contact memory is configured to write therein the unlocking authority information through a network.

7. The digital key system according to claim 1 further comprising a display unit configured to display that the microcomputer has started operating by connection of the digital key to the digital lock.

* * * * *